US011571922B2

(12) United States Patent
Johnson

(10) Patent No.: US 11,571,922 B2
(45) Date of Patent: Feb. 7, 2023

(54) CLIPBOARD AND KEY ORGANIZER WITH TAPE DISPENSER

(71) Applicant: Olga Leticia Johnson, Burleson, TX (US)

(72) Inventor: Olga Leticia Johnson, Burleson, TX (US)

(73) Assignee: Olga Leticia Johnson, Burleson, TX (US)

( * ) Notice: Subject to any disclaimer, the term of this patent is extended or adjusted under 35 U.S.C. 154(b) by 365 days.

(21) Appl. No.: 16/994,545

(22) Filed: Aug. 14, 2020

(65) Prior Publication Data

US 2021/0086547 A1 Mar. 25, 2021

Related U.S. Application Data

(60) Provisional application No. 62/886,649, filed on Aug. 14, 2019.

(51) Int. Cl.
*B42F 9/00* (2006.01)
*A45C 13/02* (2006.01)

(52) U.S. Cl.
CPC ..... *B42F 9/002* (2013.01); *A45C 13/023* (2013.01); *B42P 2241/02* (2013.01); *B42P 2241/18* (2013.01)

(58) Field of Classification Search
CPC ..... A45C 11/16; A45C 11/32; A45C 11/321; A45C 11/323; A45C 11/325; A45C 13/02; A45C 13/023; B42F 9/00; B42F 9/001; B42F 9/002; B42F 9/004; B42F 9/005; B42F 9/007; B42F 9/008; B42P 2241/02; B42P 2241/16; B42P 2241/18
USPC ..... 206/6.1, 38.1; 281/45; 362/99
See application file for complete search history.

(56) References Cited

U.S. PATENT DOCUMENTS 1,241,615 A * 10/1917 Farrow ..... E05G 1/00 312/409
1,586,086 A * 5/1926 Hodgkins ..... A45C 11/323 206/37.5
1,706,183 A * 3/1929 Porter ..... A45C 11/323 206/37.6
2,613,422 A * 10/1952 Boden ..... A45C 11/323 70/459
2,845,105 A * 7/1958 Neas ..... B42D 5/006 150/123
3,415,300 A * 12/1968 Worcester ..... A45C 13/023 206/38.1
3,977,744 A * 8/1976 DeWitt ..... A45C 11/34 312/231
4,072,033 A * 2/1978 Eckerdt ..... A47G 29/10 70/459
4,137,740 A * 2/1979 Eckerdt ..... A44B 15/005 70/456 R
4,705,086 A * 11/1987 O'Neill ..... A45C 1/04 150/145
4,848,585 A * 7/1989 Snyder ..... A45C 11/16 D6/567
4,892,334 A * 1/1990 Sinclair ..... B43L 5/02 312/231
4,978,001 A * 12/1990 Nelson ..... A47B 46/00 248/222.52

(Continued)

*Primary Examiner* — Joshua E Rodden

(57) ABSTRACT

A portable multipurpose clipboard box equipped for securing and sectioning documents, holding keys, and dispensing tape.

8 Claims, 6 Drawing Sheets

(56) References Cited

U.S. PATENT DOCUMENTS

| | | | | | |
|---|---|---|---|---|---|
| 5,035,319 | A * | 7/1991 | Kunisch | A45C 13/02 | 206/6.1 |
| D605,703 | S * | 12/2009 | Chen | D19/88 | |
| D657,560 | S * | 4/2012 | Schulz | D3/274 | |
| 9,723,904 | B1 * | 8/2017 | Taylor | A47B 96/20 | |
| D803,314 | S * | 11/2017 | Chuang | D19/88 | |
| D821,493 | S * | 6/2018 | Chuang | D19/86 | |
| D862,068 | S * | 10/2019 | Justiss | D3/207 | |
| 2003/0155762 | A1 * | 8/2003 | Gaska | B42F 9/005 | 281/45 |
| 2008/0002394 | A1 * | 1/2008 | Jones | B42F 9/004 | 362/154 |
| 2010/0116697 | A1 * | 5/2010 | Gonazlez | B42F 7/14 | 220/500 |
| 2012/0073998 | A1 * | 3/2012 | He | B42F 9/002 | 220/827 |
| 2013/0120970 | A1 * | 5/2013 | Rojo | B42F 9/004 | 362/99 |
| 2014/0346764 | A1 * | 11/2014 | Lee | B43L 1/00 | 281/45 |
| 2015/0258840 | A1 * | 9/2015 | Chang | B42F 9/001 | 220/4.21 |
| 2017/0113482 | A1 * | 4/2017 | Chang | B42F 9/008 | |
| 2021/0309042 | A1 * | 10/2021 | Ran | A45C 13/00 | |

* cited by examiner

CLIPBOARD AND KEY ORGANIZER WITH TAPE DISPENSER

FIELD OF THE INVENTION

The invention generally relates to the field of office portable organizational stationery for individuals on the go. In specific, the invention is a clipboard box with detachable key holders, a pen holder, multiple clips for holding documents, one of which is equipped for tape dispensing.

BACKGROUND OF THE INVENTION

The earliest form of a clipboard was patented in the 1870's and was referenced to as a board clip. The clipboard embodiment was originally a thin and rigid board with a clip attached for holding documents and providing little help other than a hard surface support to write on.

Since then, many attempts have been made to enhance the use of such clipboard to accommodate the needs of various businesses or individuals but have not sufficiently addressed the needs of property management or industries where documents and multiple keys are needed at the same time.

Some attempted solutions have incorporated a wide range of additions or modifications such as an overlapping section to hold additional documents, being converted into a clipboard box, adding a light, a calculator, barrels for bullets or tear gas, and ring binders to name a few.

However, these type of clipboard boxes are typically equipped with a hollow interior for carrying additional items but offer little to no organization or ability to secure items from becoming disarrayed.

SUMMARY OF THE INVENTION

The present embodiment is in the form of a clipboard box comprising of three rectangular members who's vertical left margins are hinged together and latched together with it's corresponding edges by an affixed swinging clip on the right vertical margins.

In closed position, on the outer top of said box, it is equipped with an affixed pen holder on the left margin and a hollow document clip at the upper center of said box. The clip is equipped for tape dispensing.

In open position, the interior far left of the box has an affixed document clip and a center double sided compartment that can flip to either side which is equipped with detachable key holders on both sides. Said compartment can be latched and secured to either side of the box.

Furthermore, on the interior far right side of the box is an additional affixed document clip.

It is an object of the invention to provide a Clipboard box to organize and hold multiple documents wherein they can be sectioned for easy selection without disarray.

It is another object of the invention to provide a clipboard box for holding multiple keys wherein they can be organized, identified, and easily accessed.

It is a further object of the invention to provide a clipboard box with a multi-function clip wherein you can dispense tape and easily tape documents where needed without carrying a separate tape dispenser.

The present invention facilitates organization, selection, unlocking doors, taping documents, and writing while remaining in place without disarray. Furthermore, it is designed for easy access and time management by consolidating various items in one portable clipboard box.

DETAILED DESCRIPTION OF THE PREFERRED EMBODIMENT

A clipboard box FIG. 1, key organizer FIG. 3 in conjunction with key holders FIG. 6, and tape dispenser 10 shall now be described in detail according to the preferred embodiment therein and the corresponding illustration references.

Figure 1:
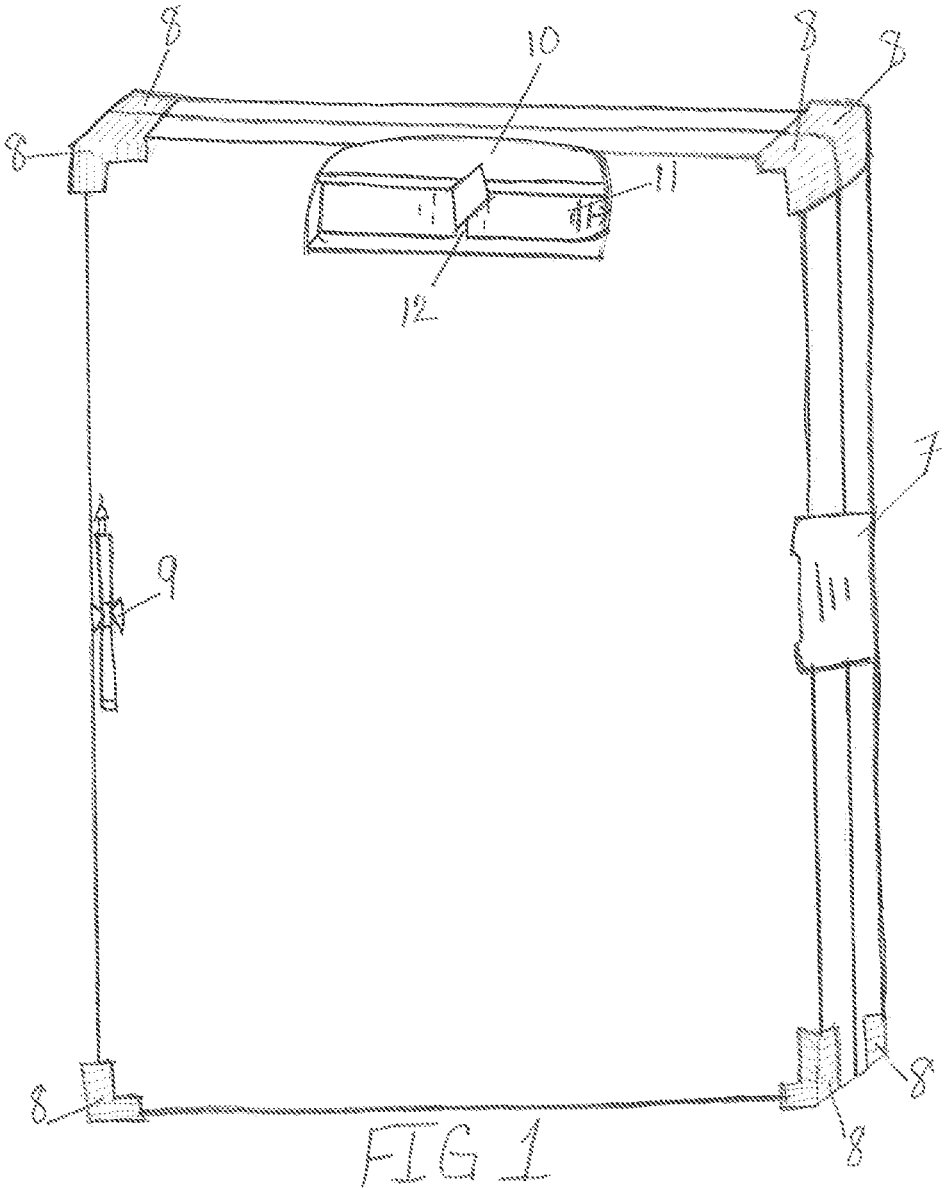
FIG. 1 Is a diagrammatic front prospective view of the Clipboard Box in closed position.
Figure 2:
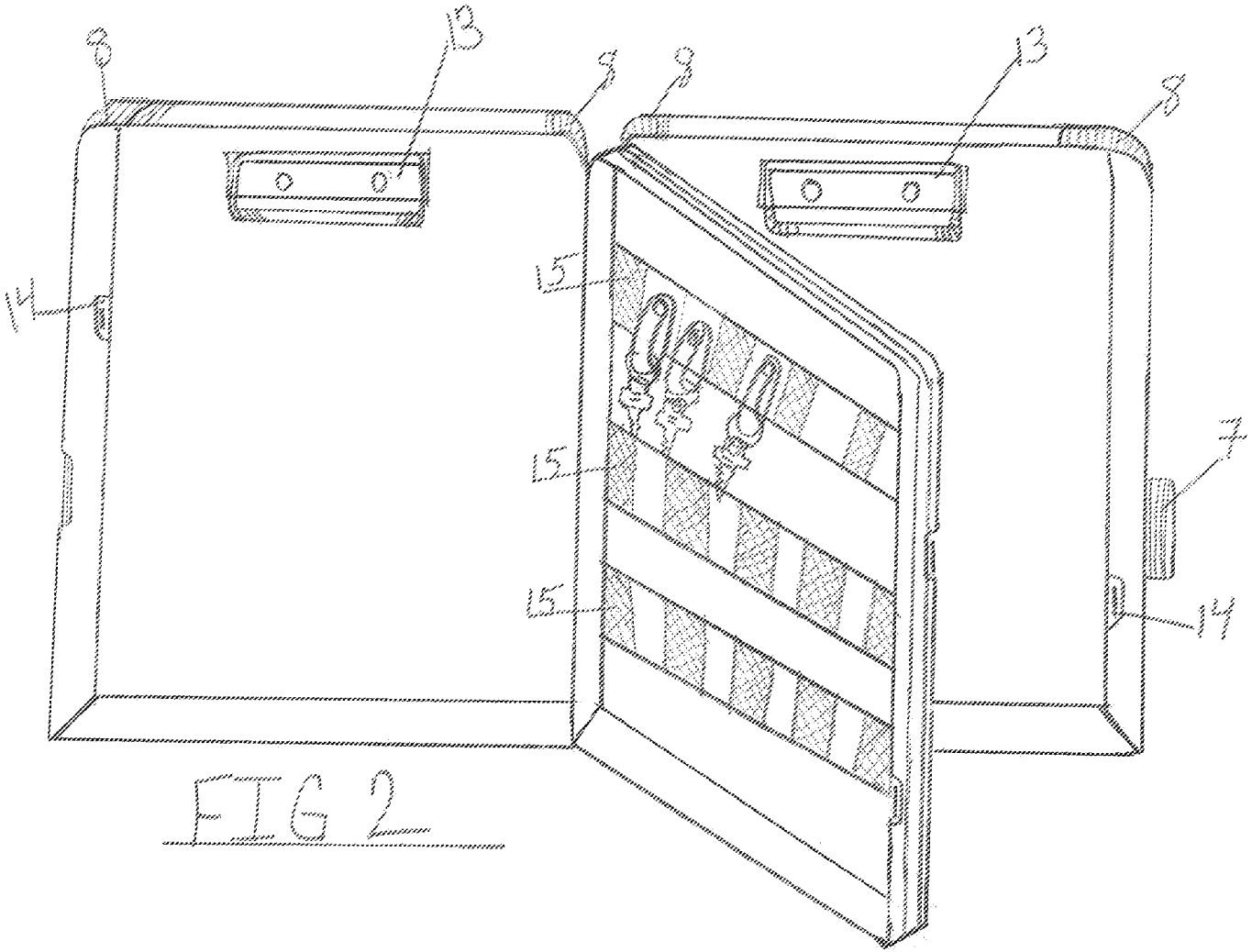
FIG. 2 Is a three-dimensional view of the clipboard box in an open stance, exhibiting the inlying design of the segments therein.
Figure 4:
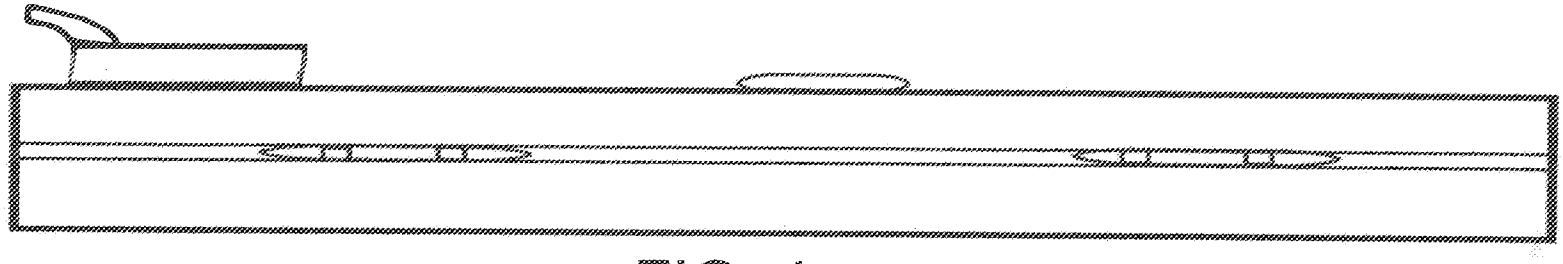
FIG. 4 Is a prospective view of the left vertical margins of the exterior of the clipboard box in closed position.
Figure 5:
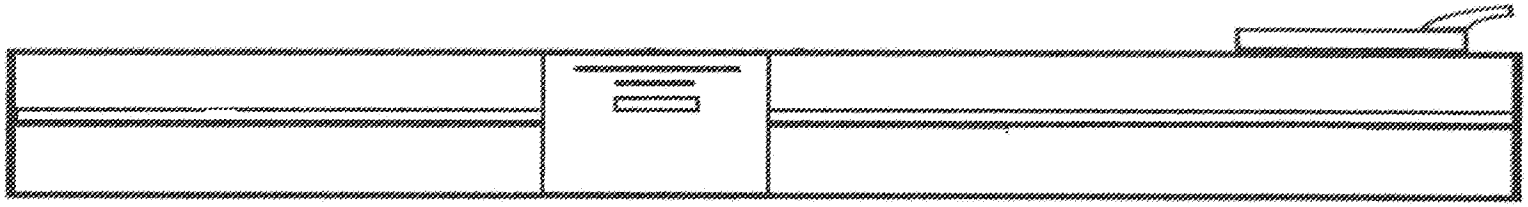
FIG. 5 Is a prospective view of the right vertical margins of the exterior of the clipboard box in closed position.

As displayed therein, clipboard box FIG. 1 comprises of three rectangular members who's left vertical margins FIG. 4 hinge together while the right vertical margins FIG. 5 along with the corresponding edges latch together by an affixed swinging clip 7, therefor enabling it to unlatch and open to a 180 degree angle as shown in FIG. 2. The embodiment demonstrates protective corners 8 on each of the corresponding corners as shown on FIG. 1. The disclosed embodiments are constructed of a wide variety of materials including but not limited to Aluminum, high impact Polystyrene, Polypropylene, PVC, and Foamex.

In closed position, on the top landing of clipboard box FIG. 1, is an affixed pen holder 9 on the center of the left vertical margin and a spring loaded lever document clip 10 secured by rivets at the horizontal upper center of said clipboard box FIG. 1. Document clip 10 has a removable section 11 therein, which when removed, exposes a shallow interior of clip 10 and enables the placing of tape strips to be dispensed through a cavity 12 remaining after the removable section 11 is inserted back in place.

In open stance as shown in FIG. 2, clipboard box FIG. 1, exposes the inlying segments therein. The far-left vertical margin contains an affixed swinging clip 14, thereby permitting for the core compartment key organizer base FIG. 3 to be latched and secured to the left side. The far-left segment also includes a flat metal document clip 13 affixed by rivets at the center upper horizontal margins therein. The far-right segment is equivalent to the far-left segment which includes a document clip 13 and an affixed swinging clip 14 which in the opposing side would permit the core compartment key organizer base FIG. 3 to be latched and secured to the right side.

Figure 3:
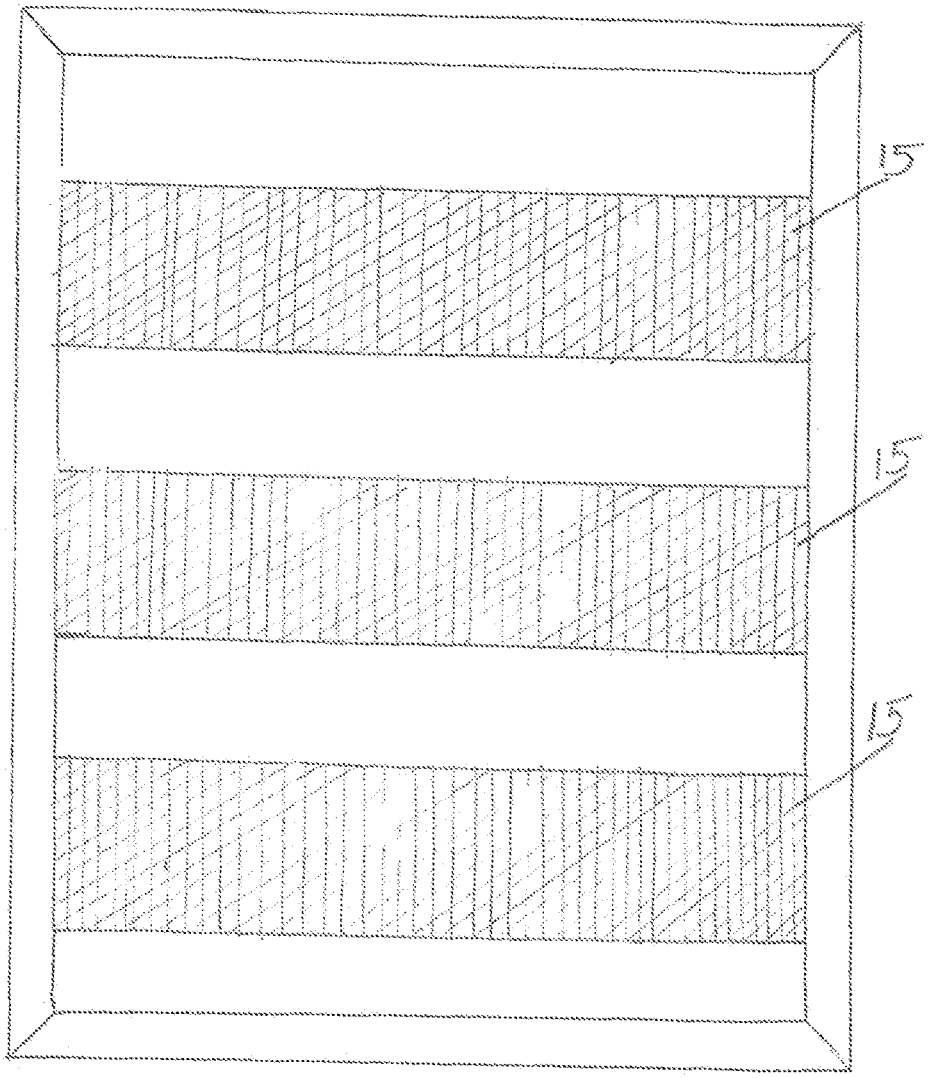
FIG. 3 Is a magnified view of 1 of 2 sides of the inlying core compartment detailing the key organizer base therein.

The inlying core key organizer FIG. 3 base, comprises of a half inch deep, double sided compartment which is equipped with rows of crochet fastening means referred to as hook 15 on both sides. Hook 15 fastening means comprise of strips backed by a layer of industrial adhesive or any other adequate adherent and placed horizontally across the key organizer FIG. 3 base compartment surface therein.

Figure 6:
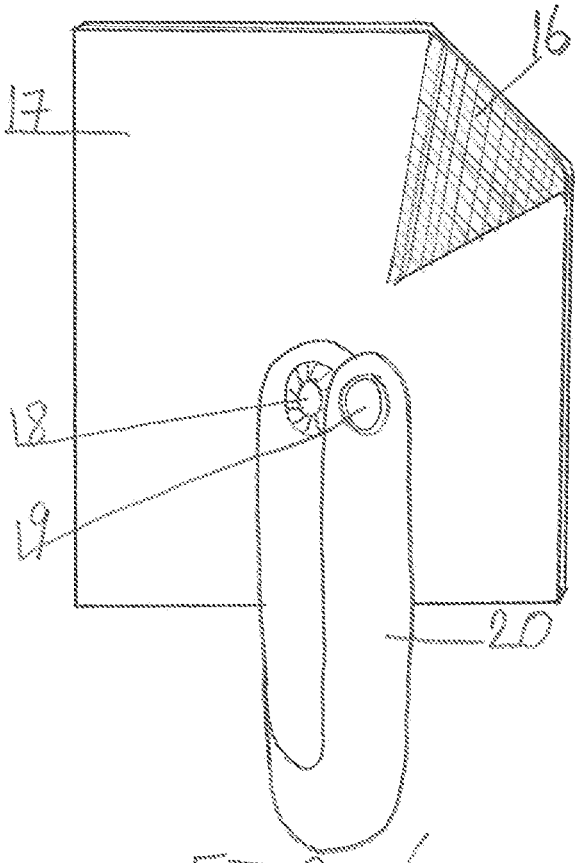
FIG. 6 Is a magnified view of a detachable key holder design corresponding to its conjunction in FIG. 3 and the manifest of cooperating fastening means.

In conjunction with the Hook 15 fastening means affixed to the key organizer FIG. 3 compartment, numerous key holders FIG. 6 attach by velvet fastening means referred to as loop 16 to each row of the hook 15. The key holder FIG. 6 embodiment comprises of a 2 cm by 2 cm top layer 17 of strong fabric or material such as but not limited to natural leather, vinyl, faux leather, or felt.

A three-inch-long PVC strap 20 is adjoined by % of an inch of one end to the back of the Key holder FIG. 6 top layer 17 using industrial adhesive, therefor leaving the remaining of said PVC strap 20 pendent. The adjoined end of PVC strap 20 leaves exposed an attached round metal stud 18 near the adjoined end, which in conjunction with the opposite end of said PVC strap 20 containing an attached socket 19 form the means of a snap button fastener therein, therefor enabling the PVC strap 20 to retain keys in the loop when stud 18 and socket 19 are fastened together.

The embodiment of key holder FIG. 6, furthermore includes a back layer comprising of loop 16 fastening means which is equitably adjoined to top layer 17, therefore concealing the preceding PVC strap 20 therein. The Key holder FIG. 6 top layer 17 and back layer loop 16 are adjoined by but not limited to industrial adhesive or any other adequate adherent, with the feasibility to sew along all margins with enduring thread.

The detailed design of the detachable key holder FIG. 6 will remain the same for every key holder as described herein.

The detailed design as described herein of the clipboard and key organizer with tape dispenser would be beneficial and of desirable use for a wide variety of industries such as property management, real estate, hotels, storage facilities, car dealerships, car rental agencies or any other type of business that utilize multiple keys and documents at the same time. The evident embodiment of the Clipboard and Key Organizer with tape dispenser will alleviate the hassle of carrying various items separate and in disarray by consolidating, organizing, and securing everything in one convenient portable item. Furthermore, according to it's design and purpose, it will increase the outcome of time management which in general would be beneficial to any business.

All elements or features of the embodiment described herein may change in size or arrangement, be replaced, substituted, or changed by any alternative materials, method or composition, while preserving the purpose of the invention.

I claim:

1. A multi-purpose clipboard box, comprising:

A pair of rectangular members forming a clipboard box with a hollow interior, hinged together for folding flexibility and securing the members in place;

An additional rectangular member with double sided walls of half of an inch in placed and hinged in between the pair of members forming said clipboard box, therefore leaving the additional rectangular member enclosed;

A plurality of strips for fastening, affixed horizontally across both sides of support surfaces of the additional rectangular member for securing detachable key holders;

An affixed swinging clip latching said pair of rectangular members and said additional rectangular member enabling the pair of rectangular and the additional rectangular members to open when unlatched;

A plurality of detachable key holders defined by a top layer of durable material of Faux Leather, a 3" long PVC strap with attached snap button fastening to which then is adhered to the top layer by one end, leaving an opposite end pendent, and a back layer of velvet or loop material which in conjunction;

A pair of swinging clips, each affixed to far opposite sides of vertical margins of the pair of rectangular members of said clipboard box for latching and securing the additional rectangular member to either one of the pair of rectangular members for sectioning purposes;

A spring-loaded document clip with a removable section along a small cavity therein and a shallow interior secured by rivets to an upper center of a horizontal margin of an outer top surface of said clipboard box;

A pair of flat metal document clips, each affixed by rivets to support surfaces on an upper center of horizontal margins of an interior of the pair of rectangular members of said clipboard box.

2. The Multi-Purpose Clipboard Box of claim 1, wherein the additional rectangular member is configured to be used as a base for organizing, attaching and detaching said detachable key holders.

3. The Multi-Purpose Clipboard Box of claim 1, wherein the strips affixed to said additional rectangular member include hook material.

4. The Multi-Purpose Clipboard Box of claim 1, wherein the back layer of each individual detachable key holder includes the loop material.

5. The Multi-Purpose Clipboard Box of claim 1, wherein the spring-loaded document clip and said removable section enable placement and dispensing of tape strips through the cavity therein.

6. The Multi-Purpose Clipboard Box of claim 1, wherein the opposite end of the PVC strap is snapped onto the one end using said snap button fastening attached therein, therefore creating a loop in which keys are configured to be placed and secured.

7. The Multi-Purpose Clipboard Box of claim 1, wherein the top and back layers of said detachable key holders are secured together making one piece by industrial strength binders including at least one of: adhesive or thread or by sewing.

8. The Multi-Purpose Clipboard Box of claim 3, wherein the strips of hook material and the back layer of velvet or loop material of said detachable key holders fasten together enabling organization of multiple keys.

* * * * *